US008218982B2

(12) United States Patent
Hirata et al.

(10) Patent No.: US 8,218,982 B2
(45) Date of Patent: Jul. 10, 2012

(54) IMAGE FORMING DEVICE HAVING A TRICKLE DEVELOPING APPARATUS

(75) Inventors: Katsuyuki Hirata, Toyokawa (JP); Kazuomi Sakatani, Toyokawa (JP); Mitsuru Obara, Toyohashi (JP); Yoshinori Tsutsumi, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 519 days.

(21) Appl. No.: 12/395,916

(22) Filed: Mar. 2, 2009

(65) Prior Publication Data

US 2009/0310985 A1 Dec. 17, 2009

(30) Foreign Application Priority Data

Jun. 12, 2008 (JP) ..... 2008-153887

(51) Int. Cl.
*G03G 15/08* (2006.01)

(52) U.S. Cl. ..... 399/30

(58) Field of Classification Search ..... 399/30, 399/53, 58, 59, 61–64, 254–259, 262, 263
See application file for complete search history.

(56) References Cited

U.S. PATENT DOCUMENTS

| | | | | |
|---|---|---|---|---|
| 5,166,732 A | * | 11/1992 | Fuji | 399/61 |
| 5,365,319 A | | 11/1994 | Sakemi et al. | |
| 5,572,299 A | * | 11/1996 | Kato et al. | 399/256 |
| 6,421,516 B1 | | 7/2002 | Kinoshita et al. | |

FOREIGN PATENT DOCUMENTS

| | | | |
|---|---|---|---|
| JP | 59-100471 A | | 6/1984 |
| JP | 63-129372 | | 6/1988 |
| JP | 5-341654 A | | 12/1993 |
| JP | 06308833 A | * | 11/1994 |
| JP | 2001-092253 | | 4/2001 |
| JP | 2002-091144 | | 3/2002 |
| JP | 2005-031327 | | 2/2005 |
| JP | 2005266280 A | * | 9/2005 |

OTHER PUBLICATIONS

Notification of Reason for Refusal issued in the corresponding Japanese Patent Application No. 2008-153887 dated May 11, 2010, and an English Translation thereof.

* cited by examiner

*Primary Examiner* — David Porta
*Assistant Examiner* — Milton Gonzalez
(74) *Attorney, Agent, or Firm* — Buchanan Ingersoll & Rooney PC

(57) ABSTRACT

The developing apparatus, having stirring members for conveying and stirring developer-tank-contained developer and a developer holder, comprises a developer replenishing tank; a magnetic-type toner concentration detecting sensor; a trickle-type discharging mechanism; conveying state switching device for temporarily blocking the flow of the developer-tank-contained developer and for temporarily switching the circulating state of the developer-tank-contained developer to the staying state thereof; and a controller for controlling replenishment operation for replenishing the toner and the carrier for replenishment to the developer tank when the toner concentration is lower than a predetermined reference toner concentration, wherein the controller determines the amounts of the toner and the carrier to be replenished on the basis of the calculated toner concentration and the estimated amount of the developer.

9 Claims, 8 Drawing Sheets

| CALCULATION RESULT (WT%) OF TONER CONCENTRATION IN STAYING STATE | DIFFERENCE (V) BETWEEN OUTPUT VOLTAGE VALUE IN STAYING STATE AND OUTPUT VOLTAGE VALUE IN CIRCULATING STATE | | | | | |
|---|---|---|---|---|---|---|
| | ~ 1.25 | 1.25 ~ 1.0 | 1.0 ~ 0.75 | 0.75 ~ 0.3 | 0.3 ~ 0.2 | 0.2 ~ |
| ~ 5.25 | 167 | 201 | 234 | 268 | 301 | 335 |
| 5.25 ~ 5.75 | 71 | 86 | 100 | 115 | 129 | 143 |
| 5.75 ~ 6.25 | 47 | 57 | 66 | 76 | 85 | 95 |
| 6.25 ~ 6.75 | 23 | 28 | 33 | 38 | 42 | 47 |
| 6.75 ~ 7.25 | 0 | 0 | 0 | 0 | 0 | 0 |
| 7.25 ~ 7.75 | 0 | 0 | 0 | 0 | 0 | 0 |
| 7.75 ~ 8.25 | 0 | 0 | 0 | 0 | 0 | 0 |
| 8.25 ~ | 0 | 0 | 0 | 0 | 0 | 0 |

[UNIT : mg]

TONER CONCENTRATION : LOW
↓
REPLENISHMENT AMOUNT : LARGE

TONER CONCENTRATION : APPROPRIATE

TONER CONCENTRATION : HIGH
↓
REPLENISHMENT AMOUNT : 0

AMOUNT OF DEVELOPER : APPROPRIATE

AMOUNT OF DEVELOPER : SMALL
↓
REPLENISHMENT AMOUNT : SMALL

AMOUNT OF DEVELOPER : LARGE
↓
REPLENISHMENT AMOUNT : LARGE

Fig. 12

IMAGE FORMING DEVICE HAVING A TRICKLE DEVELOPING APPARATUS

This application is based on applications No. 2008-153887 filed in Japan, the contents of which are hereby incorporated by reference.

BACKGROUND OF THE INVENTION

1. Field of the Invention

The present invention relates to a developing apparatus for use in an electrophotographic image forming machine and to an image forming machine incorporating the developing apparatus. More particularly, the present invention relates to a trickle developing apparatus that gradually supplies fresh developer and gradually discharge deteriorated developer and to an image forming machine incorporating the developing apparatus.

2. Description of the Related Art

As developing systems employed for electrophotographic image forming machines, the one-component developing system in which toner is used as the main component of the developer and the two-component developing system in which toner and carrier are used as the main components of the developer are known.

The two-component developing system that uses toner and carrier, in which the toner and carrier are charged by friction contact therebetween to predetermined polarities, has a characteristic that the stress on the toner is less than that in the one-component developing system that uses a one-component developer. Since the surface area of the carrier is larger than that of the toner, the carrier is less contaminated with the toner attached to the surface thereof. However, with the use for a long period, contamination (spent) attached to the surface of the carrier increases, whereby the capability of charging the toner is reduced gradually. As a result, problems of photographic fog and toner scattering occur. Although it is conceivable that the amount of the carrier stored in a two-component developing apparatus is increased to extend the life of the developing apparatus, this is undesirable because the developing apparatus becomes larger in size.

To solve the problems encountered in the two-component developer, Patent document 1 discloses the so-called trickle developing apparatus being characterized in that fresh developer is gradually replenished into the developing apparatus and developer deteriorated in charging capability is gradually discharged from the developing apparatus, whereby the increase of the deteriorated carrier is suppressed. The developing apparatus is configured to maintain the volume level of the developer inside the developing apparatus approximately constant by discharging an excessive amount of deteriorated developer using the change in the volume of the developer. In the trickle developing apparatus, the deteriorated carrier inside the developing apparatus is gradually replaced with fresh carrier, and the charging performance of the carrier inside the developing apparatus can be maintained approximately constant.

In the trickle developing apparatus, since developer is replenished while the developer inside the developing apparatus is discharged, the amount of the developer existing inside the developing apparatus changes, and the amount of the developer existing inside the developing apparatus is not constant at all times. Hence, the trickle developing apparatus has a problem of causing a toner concentration detection error owing to the difference in the amount of the developer inside the developing apparatus even though the toner concentration is the same.

As main methods for detecting the toner concentration in the two-component developing system in which toner and carrier are used, an optical detection method for detecting the content ratio of toner per unit area by detecting the reflection amount of the light irradiated to developer and a magnetic detection method for detecting the content ratio of toner per unit volume by detecting the permeability of magnetic carrier are available. The magnetic detection method is generally used in view of the cost of a sensor itself and the staining properties of the sensor.

The magnetic detection method has a problem of causing an error in the detection of the toner concentration since the permeability in the detection area changes not only owing to the change in the toner concentration but also owing to bulk density because of the principle of the detection thereof.

Hence, to prevent errors from occurring in the detection of the toner concentration, Patent document 2 has proposed a technology in which the change in the toner concentration of developer and the change in the density thereof are detected using sensors based on different detection principles, such as an optical sensor and a magnetic sensor, and the correction amount corresponding to the change in density is added to the toner concentration obtained using the optical sensor.

[Patent document 1] Japanese Patent Application Laid-Open Publication No. Sho 59-100471

[Patent document 2] Japanese Patent Application Laid-Open Publication No. Hei 05-341654

However, in the technology disclosed in Patent document 2, since multiple sensors based on different detection principles are disposed, there are problems in which it is difficult to make the developing apparatus compact, the control method therefore is complicated, and the cost is high. Furthermore, in the technology disclosed in Patent document 2, the toner concentration obtained using an optical sensor is corrected to an appropriate toner concentration using the correction amount corresponding to the change in density, but the amount of the developer inside the developing apparatus is not estimated or detected.

Moreover, in the trickle developing apparatus in which the amount of the developer existing inside the developing apparatus changes, even if the toner concentration is detected accurately, there is a problem in which if a constant amount of developer is replenished continuously, the toner concentration inside the developing apparatus becomes different from an appropriate reference toner concentration. In other words, in the case that the amount of the developer existing inside the developing apparatus is small, if a constant amount of developer is replenished continuously, the replenishment amount of toner becomes too large, and the toner concentration inside the developing apparatus continues to be higher than the reference toner concentration. Conversely, in the case that the amount of the developer existing inside the developing apparatus is large, if a constant amount of developer is replenished continuously, the replenishment amount of toner becomes too small, and the toner concentration inside the developing apparatus continues to be lower than the reference toner concentration. Hence, in both cases, the toner concentration inside the developing apparatus becomes different from the appropriate reference toner concentration.

Accordingly, the technical problem to be solved by the present invention is to provide a developing apparatus and an image forming machine capable of carrying out excellent image formation for a long period by replenishing an appropriate amount of developer depending on toner concentration and the amount of developer for a trickle developing apparatus that uses a two-component developer.

Means for Solving Problems and Operation/Working-Effect

SUMMARY OF THE INVENTION

To solve the above-mentioned technical problem, the present invention provides a developing apparatus having stirring members for stirring a developer-tank-contained developer containing toner and carrier inside a developer tank while conveying the developer and a developer holder disposed adjacent to the stirring members to supply the stirred developer-tank-contained developer to an electrostatic latent image holder, comprising:

a developer replenishing tank for replenishing the toner and the carrier to the developer tank, a toner concentration detecting sensor for detecting the toner concentration inside the developer tank, a developer amount estimating sensor for estimating the amount of the developer-tank-contained developer existing inside the developer tank, a discharging mechanism provided in the developer tank to discharge an excessive amount of the developer-tank-contained developer outside the developer tank when the amount of the developer-tank-contained developer inside the developer tank exceeds a predetermined amount, conveying state switching device for temporarily blocking the flow of the developer-tank-contained developer in the developer tank and for temporarily switching the circulating state of the developer-tank-contained developer to the staying state thereof, and a controller for controlling replenishment operation for replenishing the toner and the carrier for replenishment from the developer replenishing tank to the developer tank when the toner concentration detected using the toner concentration detecting sensor is lower than a predetermined reference toner concentration, wherein the controller calculates the toner concentration on the basis of the output value output from the toner concentration detecting sensor when the staying state is achieved and estimates the amount of the developer inside the developer tank on the basis of the difference between the circulating state output value and the staying state output value, output from the toner concentration detecting sensor, thereby determining the amounts of the toner and the carrier to be replenished on the basis of the calculated toner concentration and the estimated amount of the developer.

In the above-mentioned developing apparatus, the staying state in which the developer-tank-contained developer stays temporarily inside the developer tank and the circulating state in which the developer-tank-contained developer circulates inside the developer tank are generated using the conveying state switching device. In the staying state and the circulating state, the staying state output value and the circulating state output value are output from the toner concentration detecting sensor, respectively. Since the staying state output value is an output value in a high density state, it reflects the toner concentration inside the developer tank more accurately. Hence, a sort of approximate toner concentration approximate to the true toner concentration can be calculated on the basis of the staying state output value. On the other hand, since the circulating state output value is an output value in a low density state, it is assumed to reflect the toner concentration inside the developer tank and the amount of the developer existing inside the developer tank. Since the toner concentration inside the developer tank has already been calculated as the approximate toner concentration using the staying state output value, the difference between the circulating state output value and the staying state output value is assumed to reflect the amount of the developer. Hence, the amount of the developer existing inside the developer tank can be estimated on the basis of the difference between the circulating state output value and the staying state output value output from the toner concentration detecting sensor.

The replenishment amount required for obtaining the desired toner concentration is determined on the basis of a calculation formula or a table experimentally acquired from the relationship between the calculated toner concentration and the estimated amount of developer and the amount of replenishment, and the replenishment amount is replenished to the developer tank. Hence, an appropriate amount of developer depending on the toner concentration and the amount of the developer inside the developing apparatus is replenished for the trickle developing apparatus that uses a two-component developer, whereby excellent image formation can be carried out for an extended period.

The conveying state switching device can be embodied in various configurations. The conveying state switching device can be installed inside or outside the developing apparatus. As an example in which the conveying state switching device is installed outside the developing apparatus, it is possible to have a configuration in which two shielding plates disposed orthogonal to the conveying passage and opposed to each other are inserted from the outside of the developer tank toward the stirring member, thereby shielding the conveying passage and generating the staying state, and the two shielding plates located inside the developer tank are extracted to the outside of the developer tank, thereby opening the conveying passage and generating the circulating state. However, in the case that the conveying state switching device is installed outside the developer tank, there is a problem in maintaining air tightness between the developer tank and the shielding plates because of the repetition of the insertion and extraction. It is thus preferable that the conveying state switching device should be installed inside the developer tank from the viewpoint of maintaining air tightness; for example, the conveying state switching device comprises an opening section disposed orthogonal to the conveying passage of the developer tank and a shielding section installed on the stirring member and formed so as to shield the opening section; the circulating state is generated when the opening section is not overlapped with the shielding section, and the staying state is generated when the opening section is overlapped with the shielding section.

The above-mentioned conveying state switching device can be embodied in various configurations; for example, the opening section of the conveying state switching device is a semicircular opening section obtained by cutting off the lower portion of the conveying cross-section of the developer tank. Since the lower portion of the conveying cross-section is used as part of the ordinary conveying passage, the semicircular opening section provided in the lower portion of the conveying cross-section is advantageous in that it hardly causes resistance to the conveyance.

Alternatively, the opening section is a slit-shaped opening section obtained by cutting into a slit shape at multiple positions in the conveying cross-section of the developer tank.

The above-mentioned developing apparatus is incorporated and used in an image forming machine comprising a rotatable electrostatic latent image holder for holding electrostatic latent images on the circumferential face thereof, stirring members for stirring a developer-tank-contained developer containing toner and carrier inside a developer tank while conveying the developer, and a developer holder disposed adjacent to the stirring members to supply the stirred developer-tank-contained developer to the electrostatic latent image holder.

BRIEF DESCRIPTION OF THE DRAWINGS

FIG. 12 is a view illustrating a method for determining the replenishment amount of the replenishment developer on the basis of the toner concentration and the difference between the output voltage value in the circulating state and the output voltage value in the staying state;

DESCRIPTION OF THE PREFERRED EMBODIMENT

Figure 1:
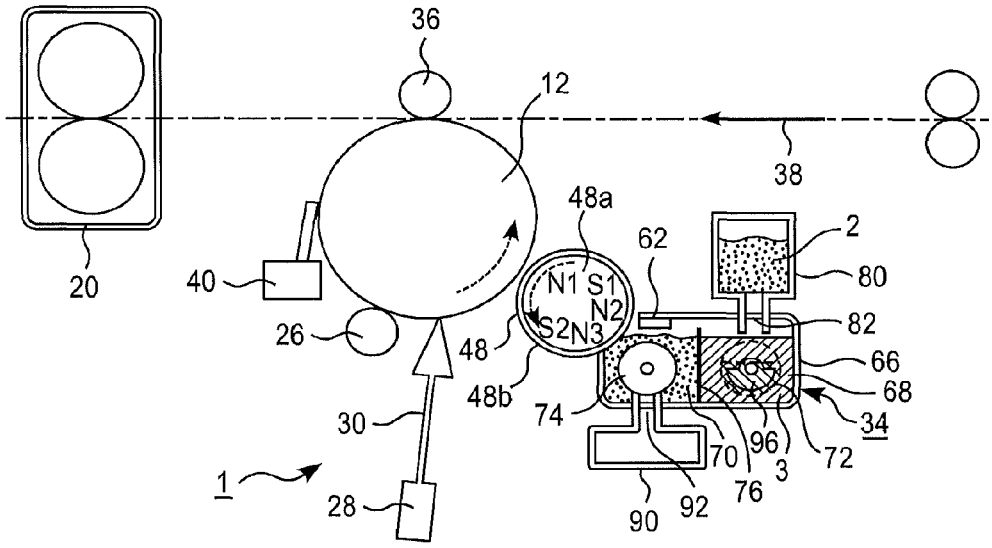
FIG. 1 is a view showing the outline configuration of an image forming machine according to a first embodiment of the present invention.

A preferred embodiment according to the present invention will be described below referring to the accompanying drawings. Although terms meaning specific directions (for example, "above," "below," "left" and "right" and other terms including these, and "clockwise" and "counterclockwise") are used in the following description, they are used for purposes of facilitating the understanding of the present invention referring to the drawings, and it should not be construed that the present invention is limited by the meanings of the terms. Furthermore, in an image forming machine 1 and a developing apparatus 34 described below, identical or similar components are designated by the same reference numerals.

The image forming machine 1 and the developing apparatus 34 incorporated therein according to a first embodiment of the present invention will be described referring to FIGS. 1 to 6.

Image Forming Machine

FIG. 1 shows the components relating to image formation in the electrophotographic image forming machine 1 according to the present invention. The image forming machine 1 may be a copier, a printer, a facsimile machine or a compound machine combinedly equipped with the functions of these. The image forming machine 1 has a photosensitive member 12 serving as an electrostatic latent image holder. Although the photosensitive member 12 is formed of a cylinder in this embodiment, the photosensitive member 12 is not limited to have such a shape in the present invention, but it is possible to use an endless belt-type photosensitive member instead. The photosensitive member 12 is connected to a motor (not shown) so as to be driven and is rotated on the basis of the driving of the motor in the direction indicated by the arrow. Around the circumference of the photosensitive member 12, a charging device 26, an exposure device 28, a developing apparatus 34, a transfer device 36 and a cleaning device 40 are respectively arranged along the rotation direction of the photosensitive member 12.

The charging device 26 charges the photosensitive layer, that is, the outer circumferential face of the photosensitive member 12, to a predetermined potential. Although the charging device 26 is represented as a cylindrical roller in this embodiment, instead of this, it is also possible to use charging devices of other forms (for example, a rotary or fixed brush type charging device and a wire discharging type charging device). The exposure device 28 disposed at a position close to or away from the photosensitive member 12 emits image light 30 toward the outer circumferential face of the charged photosensitive member 12. An electrostatic latent image having an area wherein the image light 30 is projected and the charged potential is attenuated and an area wherein the charged potential is almost maintained is formed on the outer circumferential face of the photosensitive member 12 that has passed the exposure device 28. In this embodiment, the area wherein the charged potential is attenuated is the image area of the electrostatic latent image, and the area wherein the charged potential is almost maintained is the non-image area of the electrostatic latent image. The developing apparatus 34 develops the electrostatic latent image into a visible image using a developer-tank-contained developer 3 described later. The details of the developing apparatus 34 are described later. The transfer device 36 transfers the visible image formed on the outer circumferential face of the photosensitive member 12 onto paper 38 or film. Although the transfer device 36 is shown as a cylindrical roller in the embodiment shown in FIG. 1, it is also possible to use transfer devices having other forms (for example, a wire discharging type transfer device). The cleaning device 40 recovers non-transferred toner not transferred to the paper 38 by the transfer device 36 but remaining on the outer circumferential face of the photosensitive member 12 from the outer circumferential face of the photosensitive member 12. Although the cleaning device 40 is shown as a plate-like blade in this embodiment, instead of this, it is also possible to use cleaning devices having other forms (for example, a rotary or fixed brush-type cleaning device).

When the image forming machine 1 configured as described above forms an image, the photosensitive member 12 is rotated counterclockwise, for example, on the basis of the driving of the motor (not shown). At this time, the outer circumferential area of the photosensitive member 12 passing the charging device 26 is charged to a predetermined potential at the charging device 26. The outer circumferential area of the charged photosensitive member 12 is exposed to the image light 30 at the exposure device 28, and an electrostatic latent image is formed. As the photosensitive member 12 is rotated, the electrostatic latent image is conveyed to the developing apparatus 34 and developed into a visible image using the developing apparatus 34. As the photosensitive member 12 is rotated, the toner image developed into the visible image is conveyed to the transfer device 36 and transferred to the paper 38 using the transfer device 36. The paper 38 to which the toner image is transferred is conveyed to a fixing device 20, and the toner image is fixed to the paper 38. The outer circumferential area of the photosensitive member 12 having passed the transfer device 36 is conveyed to the cleaning device 40 in which the toner not transferred to the paper 38 but remaining on the outer circumferential face of the photosensitive member 12 is scraped off from the photosensitive member 12.

Developing Apparatus

The developing apparatus 34 is provided with a two-component developer containing non-magnetic toner (hereafter simply referred to as toner) and magnetic carrier (hereafter simply referred to as carrier) and a developer tank 66 accommodating various members. The developer tank 66 has an opening section being open toward the photosensitive member 12, and a developing roller 48 is installed in a space formed near the opening section. The developing roller 48 serving as a developer holder is a cylindrical member that is rotatably supported in parallel with the photosensitive member 12 while having a predetermined developing gap to the outer circumferential face of the photosensitive member 12.

The developing roller 48 is the so-called magnetic roller having a magnet 48*a* secured so as not to be rotatable and a cylindrical sleeve 48*b* (first rotating cylinder) supported so as to be rotatable around the circumference of the magnet 48*a*. Above the sleeve 48*b* of the developing roller 48, a regulating plate 62 secured to the developer tank 66 and extending in parallel with the center axis of the sleeve 48*b* of the developing roller 48 is disposed so as to be opposed thereto with a predetermined regulating gap therebetween. The magnet 48*a* disposed inside the developing roller 48 has five magnetic poles N1, S2, N3, N2 and S1 in the rotation direction of the sleeve 48*b*. Among these magnetic poles, the main magnetic pole N1 is disposed so as to be opposed to the photosensitive member 12. The magnetic poles N2 and N3 having the same polarity and generating a repulsive magnetic field for detaching the developer from the surface of the sleeve 48*b* are disposed so as to be opposed to each other inside the developer tank 66. The sleeve 48*b* of the developing roller 48 rotates in the direction opposite to the rotation direction of the photosensitive member 12 (counter direction).

Figure 2:
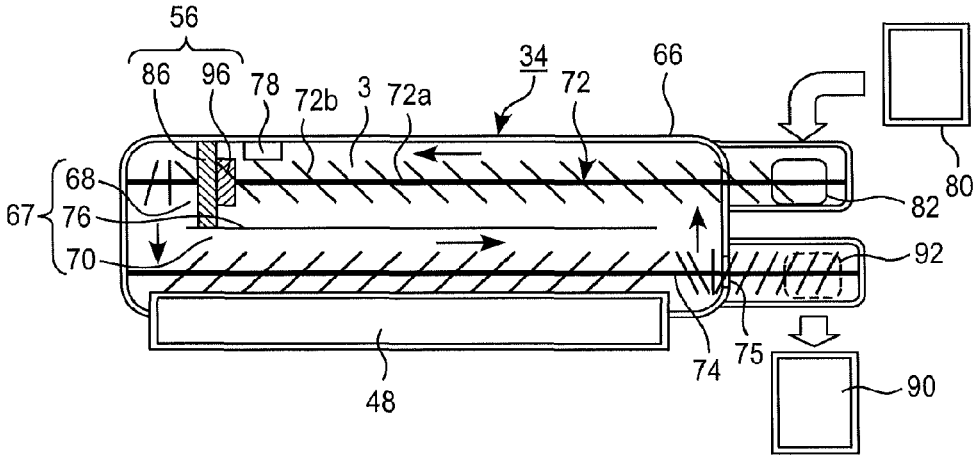
FIG. 2 is a schematic sectional view showing the developing apparatus of the image forming machine shown in FIG. 1 as seen from above.

FIG. 2 is a schematic sectional view showing the developing apparatus 34 as seen from above. As shown in FIG. 2, a developer stirring and conveying chamber 67 is formed behind the developing roller 48. The developer stirring and conveying chamber 67 comprises a second conveying passage 70 formed near the developing roller 48, a first conveying passage 68 formed away from the developing roller 48 and a partition wall 76 for partitioning the space between the first conveying passage 68 and the second conveying passage 70. Above the upstream side of the conveying direction of the first conveying passage 68, a developer replenishing tank 80 is disposed, and the developer replenishing tank 80 communicates with the first conveying passage 68 via a replenishing port 82. The developer replenishing tank 80 is filled with a replenishment developer 2 containing toner as a major ingredient and carrier. The ratio of the carrier in the replenishment developer 2 is preferably 5 to 40 wt %, further preferably 10 to 30 wt %. In addition, below the downstream side of the conveying direction of the second conveying passage 70, a developer recovery tank 90 is disposed, and the developer recovery tank 90 communicates with the second conveying passage 70 via a recovery port 92.

At the bottom of the developer replenishing tank 80, a developer supplying roller is disposed, the driving operation of which is controlled using a controller 100. When the developer supplying roller is rotated by driving and rotating a motor for replenishment, the replenishment developer 2, which is fresh and the amount of which corresponds to the driving time of the roller, flows downward and is supplied to the first conveying passage 68 of the developer tank 66.

In the first conveying passage 68, a first screw 72 serving as a stirring member for conveying the developer-tank-contained developer 3 while stirring the developer is rotatably supported. In the second conveying passage 70, a second screw 74 for conveying the developer-tank-contained developer 3 from the first conveying passage 68 to the developing roller 48 while stirring the developer is rotatably supported. The first screw 72 and the second screw 74 are each a spiral screw in which a spiral vane with a predetermined pitch is secured to a shaft. In this case, the upper portions of the partition wall 76 located at both end sections of the first conveying passage 68 and the second conveying passage 70 are cut out, and communicating passages are formed. The developer-tank-contained developer 3 having reached the end section on the downstream side in the conveying direction of the first conveying passage 68 is sent into the second conveying passage 70 via the communicating passage, and the developer-tank-contained developer 3 having reached the end section on the downstream side in the conveying direction of the second conveying passage 70 is sent into the first conveying passage 68 via the communicating passage. As a result, the developer-tank-contained developer 3 is circulated inside the developer stirring and conveying chamber in the direction indicated by the arrows shown in FIG. 2.

Figure 4:
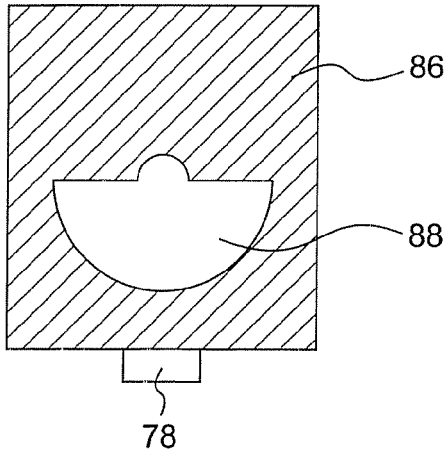
FIG. 4 is a schematic sectional view of the developer tank side shielding plate of the image forming machine shown in FIG. 1 as seen from the axial direction thereof.

On the downstream side of the first conveying passage 68, a developer tank side shielding plate 86 is installed upright so as to be perpendicular to the conveying direction of the developer-tank-contained developer 3. It is preferable that the developer tank side shielding plate 86 should be disposed on the extreme downstream side of the first conveying passage 68 and ahead of the communicating passage to the second conveying passage 70 so that the measurement is performed for the developer-tank-contained developer that has been charged more densely. The developer tank side shielding plate 86 is configured so as to wholly shield the first conveying passage 68. For example, in the case that the cross-section of the first conveying passage 68 has an approximately rectangular shape as shown in FIG. 4, the developer tank side shielding plate 86 also has an approximately rectangular shape corresponding thereto. Furthermore, in the case that the cross-section of the first conveying passage 68 has an approximately circular shape, not shown, the developer tank side shielding plate 86 also has an approximately circular shape corresponding thereto. In both cases, the developer tank side shielding plate 86 is provided with an opening section 88 obtained by cutting off the approximately lower portion of the cross-section of the first conveying passage 68 to securely obtain the conveying passage for the developer-tank-contained developer 3 in the first conveying passage 68. The opening section 88 has a small semicircular portion that is obtained by cutting off the portion corresponding to the upper half of a shaft 72*a* so that the shaft 72*a* can rotate and a large semicircular portion that is smaller than the outside-diameter shape of a vane 72*b* described later and obtained by cutting off the portion corresponding to the approximately half of the vane 72*b*.

Figure 5:
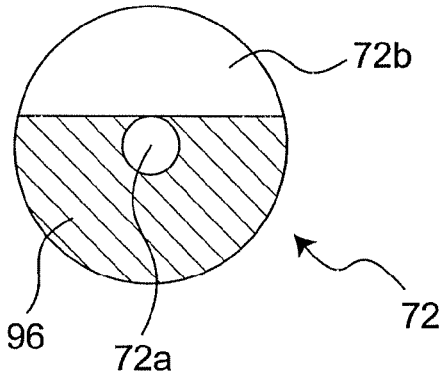
FIG. 5 is a schematic sectional view of the first screw of the image forming machine shown in FIG. 1 as seen from the axial direction thereof.

As shown in FIG. 5, the first screw 72 is a spiral screw in which the spiral vane 72*b* with a predetermined pitch is secured to the shaft 72*a* and is provided with a shielding section 96 having an approximately semicircular disc shape. The shielding section 96 installed upright so as to be perpendicular to the shaft 72*a* is configured so as to have an outside diameter being approximately the same as that of the vane 72*b* and so as to be larger than the semicircle by the amount corresponding to the height of the shaft 72*a*. The shielding section 96 is configured so as to be disposed opposed to the developer tank side shielding plate 86 of the first conveying passage 68. When the first screw 72 is incorporated in the first conveying passage 68 and rotated, the shielding section 96 is in a state of being positioned on the upstream side of the developer tank side shielding plate 86 and is rotated while making slide contact with the developer tank side shielding plate 86. When the shielding section 96 not overlapped is rotated by an angle of 180 degrees with respect to the developer tank side shielding plate 86, for example, and even when the opening section 88 of the developer tank side shielding plate 86 is overlapped with the shielding section 96, the developer-tank-contained developer 3 does not leak from the clearance therebetween, whereby the staying state in which the developer-tank-contained developer 3 stays temporarily is generated.

In this way, the conveying state switching device 56 for switching the conveying state of the developer-tank-contained developer 3 between the circulating state and the staying state is configured using the opening section 88 of the developer tank side shielding plate 86 and the shielding section 96 of the first screw 72.

Figure 6:
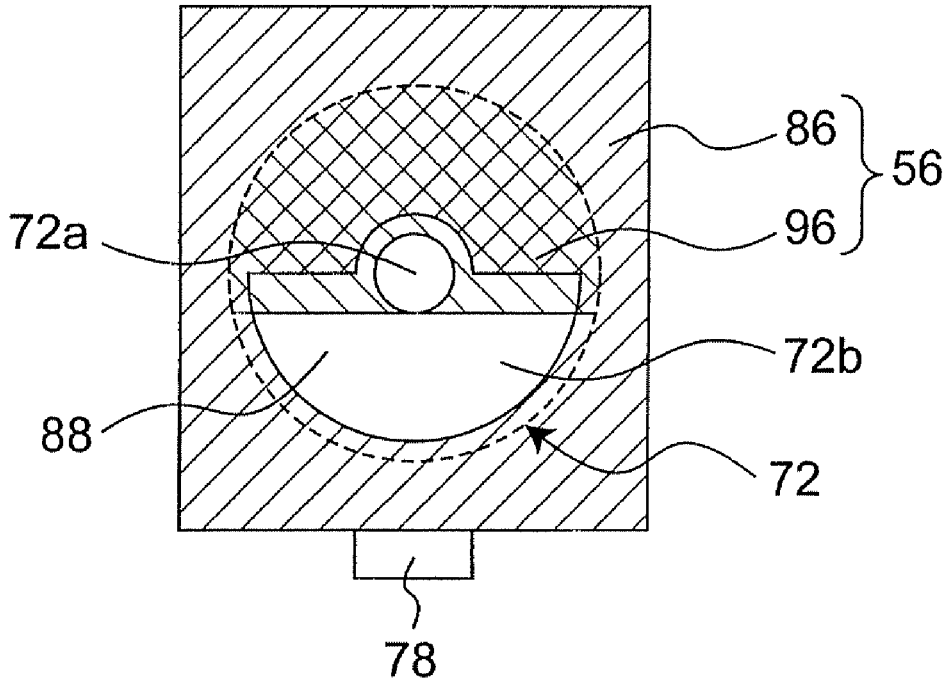
FIG. 6 is a schematic view showing that the conveying state switching device comprising the combination of the developer tank side shielding plate shown in FIG. 4 and the first screw shown in FIG. 5 is in a circulating state.
Figure 8:
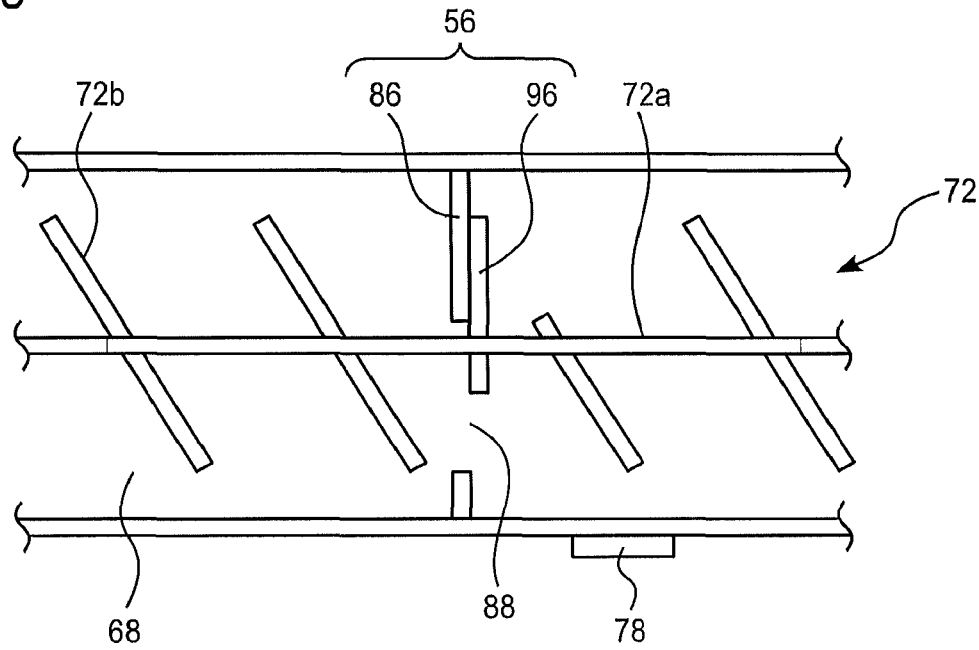
FIG. 8 is a schematic side view showing the circulating state of the conveying state switching device shown in FIG. 6.

FIGS. 6 and 8 schematically show that the opening section 88 of the developer tank side shielding plate 86 installed in the developer tank 66 is not overlapped with the shielding section 96 installed on the first screw 72, whereby the state in which the opening section 88 is open, the circulating state, is generated.

Figure 7:
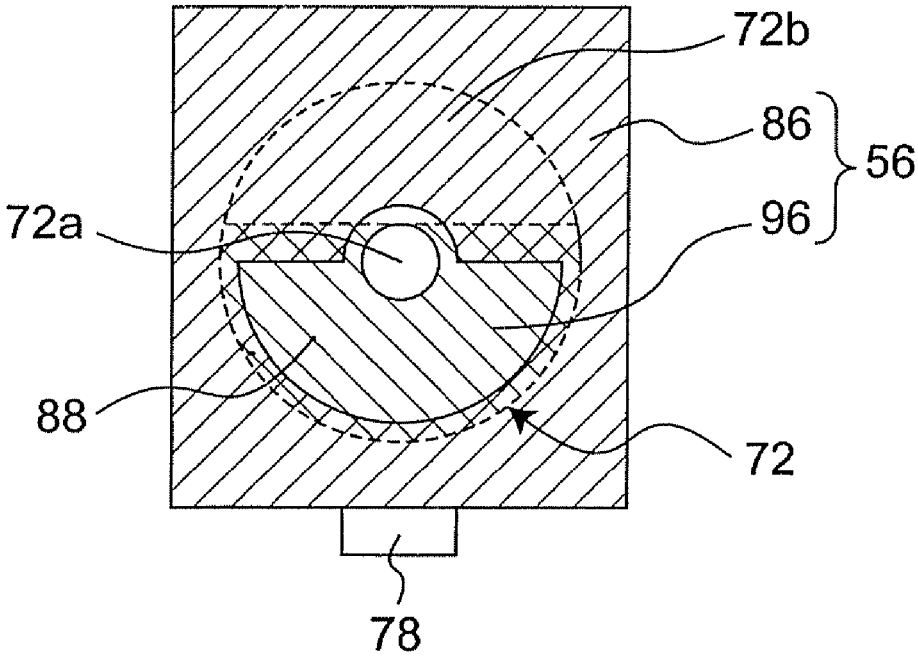
FIG. 7 is a schematic view showing that the conveying state switching device comprising the combination of the developer tank side shielding plate shown in FIG. 4 and the first screw shown in FIG. 5 is in a staying state.
Figure 9:
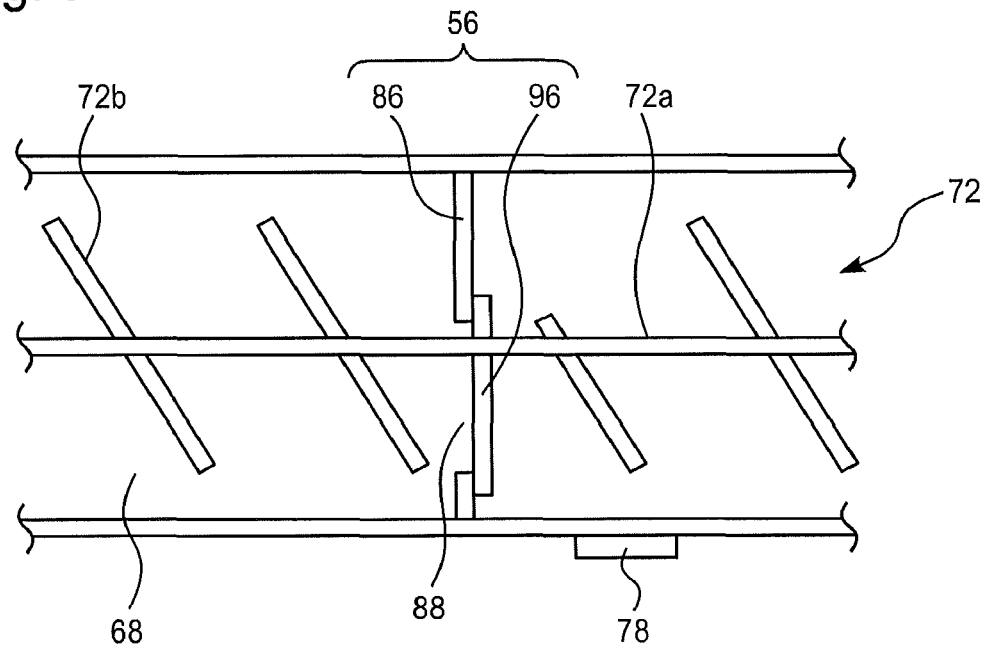
FIG. 9 is a schematic side view showing the staying state of the conveying state switching device shown in FIG. 7.

FIGS. 7 and 9 schematically show that the first screw 72 positioned in the above-mentioned circulating state is rotated by an angle of 180 degrees and the opening section 88 of the developer tank side shielding plate 86 installed in the developer tank 66 is overlapped with the shielding section 96 installed on the first screw 72, whereby the state in which the opening section 88 is closed, the staying state, is generated.

In the circulating state shown in FIGS. 6 and 8, part of the shielding section 96 on the opposite side of the shaft is shown so as to be slightly overlapped with the opening section 88. This is intended to, as far as possible, prevent the developer-tank-contained developer 3 from leaking from the clearance formed when the shaft 72*a* of the first screw 72 is inserted through the opening section of the developer tank side shielding plate 86 in the staying state.

At the right end section shown in FIG. 2, the second screw 74 is extended rightward in the figure and further extended above the recovery port 92. At each of the positions corresponding to the communicating passage from the second conveying passage 70 to the first conveying passage 68 and to the downstream side end section of the second conveying passage 70, the second screw 74 has a reverse vane section in which the spiral direction of the spiral screw is opposite to that at the other section. The pitch of the vane of the second screw 74 at the downstream side end section (the right end section in FIG. 2) in the conveying direction is made smaller than that at the other section. As a result, when the second screw 74 is rotated, the level of the developer-tank-contained developer 3 at the downstream side end section (the right end section) in the conveying direction of the second screw 74 becomes higher than that at the other vane section. In other words, a rising of the developer-tank-contained developer 3 is formed at the downstream side end section (the right end section) in the conveying direction of the second conveying passage 70.

Since the developing apparatus 34 employs the so-called trickle system, the developing apparatus has an outlet 75 for allowing an excessive amount of the developer-tank-contained developer 3 to flow out. In other words, the outlet 75 is formed by providing a cutout 75 that is formed by partially cutting out the upper portion of the side wall located at the downstream side end section (the right end section) in the conveying direction of the second conveying passage 70. In a usual state, the developer being conveyed using the second screw 74 is stopped using the reverse vane section and conveyed from the second conveying passage 70 to the first conveying passage 68 as indicated by the solid-line arrows shown in FIG. 2. When the developer-tank-contained developer 3 increases inside the developer tank and the developer level inside the developer tank rises, the developer-tank-contained developer 3 climbs over the outlet 75 disposed at the upper portion of the side wall against the stopping action of the reverse vane section and overflows to a recovery chamber adjacent thereto. The excessive amount of the developer-tank-contained developer 3 overflowed to the recovery chamber is conveyed to the recovery port 92 and recovered (dumped) into the developer recovery tank 90 via the recovery port 92.

In the developing apparatus 34, when the toner concentration of the circulating developer-tank-contained developer 3 lowers as the printing operation proceeds, the replenishment developer 2 containing toner and a small amount of carrier is replenished from the developer replenishing tank 80. The replenishment developer 2 is supplied in a form in which toner and carrier are integrated or in a form in which toner and carrier are separated. The fresh replenishment developer 2 having been replenished is conveyed along the first conveying passage 68 and the second conveying passage 70 of the above-mentioned developer stirring and conveying chamber 67 while being mixed and stirred with the developer-tank-contained developer 3 already existing therein. Although the toner is basically consumed on the photosensitive member 12, the carrier is accumulated inside the developing apparatus 34, and the charging performance of the carrier lowers gradually as the number of printed sheets increases. Since a small amount of the carrier that is bulkier than the toner is contained in the replenishment developer 2, as the replenishment developer 2 is replenished, the amount of the developer-tank-contained developer 3 gradually increases inside the developing apparatus 34. Then, the developer-tank-contained developer 3 having increased in volume circulates in the developer stirring and conveying chamber 67. An excessive amount of the developer-tank-contained developer 3 being unable to circulate in the developer stirring and conveying chamber 67 climbs over the reverse vane section and flows out from the outlet 75 provided at the downstream side end section (the right end section) in the conveying direction of the second conveying passage 70 and is recovered in the developer recovery tank 90 via the recovery port 92.

The first conveying passage 68 and the second conveying passage 70 constituting the developer stirring and conveying chamber 67 can have various configurations; for example, the passages are disposed at the same height as shown in FIG. 1 or disposed at different heights (not shown).

The replenishing amount of the replenishment developer 2 is determined on the basis of the toner concentration of the developer-tank-contained developer 3 detected using the toner concentration detecting sensor 78, the image information (dot counter) at the time of image formation and the ratio of the carrier in the replenishment developer 2 inside the developer replenishing tank 80. The ratio of the carrier in the replenishment developer 2 inside the developer replenishing tank 80 is adjusted to the extent that the carrier inside the developing apparatus 34 is suppressed from deteriorating and that the cost is not increased. As the toner replenishing operation proceeds, the carrier is supplied gradually.

Figure 3:
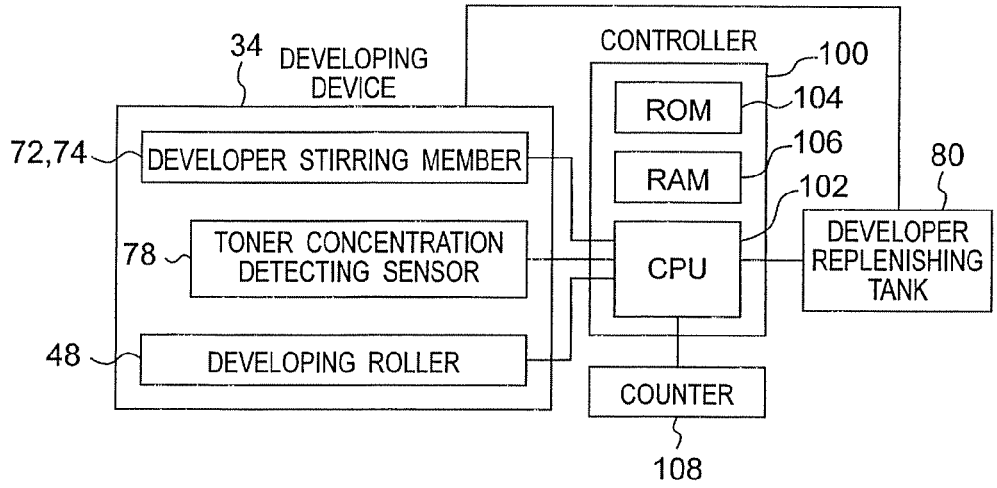
FIG. 3 is a block diagram of the developing apparatus of the image forming machine shown in FIG. 2.

FIG. 3 is a control block diagram of the developing apparatus 34 of the image forming machine 1.

The controller 100 serving as controlling means comprises a CPU (central processing unit) 102, a ROM (read only memory) 104, a RAM (random access memory) 106, etc. The CPU 102 concentratedly controls various operations in the image forming machine 1 according to various processing programs and tables stored inside the ROM 104. In the ROM 104, for example, a toner concentration calculation table for carrying out calculation for conversion to the toner concentration of the developer-tank-contained developer 3 on the basis of the output voltage value output from the toner concentration detecting sensor 78, a developer amount estimating table or a calculation formula for estimating the amount of the developer-tank-contained developer 3 on the basis of the difference between the output voltage value in the staying state and the output voltage value in the circulating state, output from the toner concentration detecting sensor 78, and a developer replenishing table or a calculation formula for calculating the amount of the replenishment developer 2 on the basis of the calculated toner concentration and the estimated amount of the developer are stored. The RAM 106 provides a work area in which various programs to be executed by the controller 100 and data for the programs are temporarily stored.

The developing apparatus 34, the developer replenishing tank 80 and a counter 108 are connected to the CPU 102. The operations of the stirring members 72 and 74, the toner concentration detecting sensor 78 and the developing roller 48, constituting the developing apparatus 34, are controlled using the CPU 102 of the controller 100. The CPU 102 of the controller 100 is used as stirring member rotation controller for controlling the rotation speeds of the stirring members 72 and 74. Furthermore, the output voltage value in the staying state and the output voltage value in the circulating state, output from the toner concentration detecting sensor 78, the toner concentration calculated using the output voltage value in the staying state, image information at the time of image formation, the ratio of the carrier in the replenishment developer 2 inside the developer replenishing tank 80, etc. are temporarily stored in the RAM 106.

Developer

The two-component developer contains toner and carrier for charging the toner. In the present invention, the known toner that has been used generally and conventionally can be used for the image forming machine 1. The particle diameter of the toner is, for example, approximately 3 to 15 μm. It is also possible to use toner containing a coloring agent in a binder resin, toner containing a charge control agent and a releasing agent, and toner holding additives on the surface.

The toner is produced using known methods, such as the grinding method, the emulsion polymerization method and the suspension polymerization method.

Examples of the binder resin being used for the toner include styrene resins (homopolymers or copolymers containing styrene or styrene substitutes), polyester resins, epoxy resins, polyvinyl chloride resins, phenol resins, polyethylene resins, polypropylene resins, polyurethane resins, silicone resins or any appropriate combinations of these resins, although not restricted to these. The softening temperature of the binder resin is preferably in the range of approximately 80 to 160° C., and the glass transition temperature thereof is preferably in the range of approximately 50 to 75° C.

As the coloring agent, it is possible to use known materials, such as carbon black, aniline black, activated charcoal, magnetite, benzine yellow, permanent yellow, naphthol yellow, phthalocyanine blue, fast sky blue, ultramarine blue, rose bengal and lake red. In general, the additive amount of the coloring agent is preferably 2 to 20 parts by weight per 100 parts by weight of the binder resin.

The materials conventionally known as charge control agents can be used as the charging control agent. More specifically, for the toner that is positively charged, it is possible to use materials, such as nigrosin dyes, quaternary ammonium salt compounds, triphenylmethane compounds, imidazole compounds and polyamine resins, as the charge control agent. For the toner that is negatively charged, it is possible to use materials, such as azo dyes containing metals such as Cr, Co, Al and Fe, salicylic acid metal compounds, alkyl salicylic acid metal compounds and calixarene compounds, as the charge control agent. It is desirable that the charge control agent is used in the ratio of 0.1 to 10 parts by weight per 100 parts by weight of the binder resin.

The materials conventionally known and used as releasing agents can be used as the releasing agent. As the material of the releasing agent, it is possible to use materials, such as polyethylene, polypropylene, carnauba wax, sasol wax or any appropriate combinations of these. It is desirable that the releasing agent is used in the ratio of 0.1 to 10 parts by weight per 100 parts by weight of the binder resin.

Furthermore, it may be possible to add a fluidizer for accelerating the fluidization of the developer. As the fluidizer, it is possible to use inorganic particles, such as silica, titanium oxide and aluminum oxide, and resin particles, such as acrylic resins, styrene resins, silicone resins and fluororesins. It is particularly desirable to use materials hydrophobized using a silane coupling agent, a titanium coupling agent, silicone oil, etc. It is desirable that the fluidizer is added in the ratio of 0.1 to 5 parts by weight per 100 parts by weight of the toner. It is desirable that the number average primary particle diameters of these additives are in the range of 9 to 100 nm.

As the carrier, the known carriers used conventionally and generally can be used. Either the binder-type carrier or the coated-type carrier may be used. It is desirable that the diameter of the carrier particles is in the range of approximately 15 to 100 μm, although not restricted to this range.

The binder-type carrier is that obtained by dispersing magnetic particles in a binder resin and it is possible to use carrier having positively or negatively charged particles or a coating layer on its surface. The charging characteristics, such as polarity, of the binder-type carrier can be controlled depending on the material of the binder resin, electrostatic charging particles and the kind of the surface coating layer.

Examples of the binder resin being used for the binder-type carrier include thermoplastic resins, such as vinyl resins typified by polystyrene resins, polyester resins, nylon resins and polyolefin resins, and thermosetting resins, such as phenol resins.

As the magnetic particles of the binder-type carrier, it is possible to use spinel ferrites, such as magnetite and gamma ferric oxide; spinel ferrites containing one or more kinds of nonferrous metals (such as Mn, Ni, Mg and Cu); magnetoplumbite ferrites, such as barium ferrite; and iron or alloy particles having oxide layers on the surfaces. The shape of the carrier may be particulate, spherical or needle-like. In particular, when high magnetization is required, it is desirable to use iron-based ferromagnetic particles. In consideration of chemical stability, it is desirable to use ferromagnetic particles of spinel ferrites, such as magnetite and gamma ferric oxide, or magnetoplumbite ferrites, such as barium ferrite. It is possible to obtain magnetic resin carrier having the desired magnetization by appropriately selecting the kind and content of the ferromagnetic particles. It is appropriate to add 50 to 90 wt % of the magnetic particles to the magnetic resin carrier.

As the surface coating material of the binder-type carrier, it is possible to use silicone resins, acrylic resins, epoxy resins, fluororesins, etc. The charging capability of the carrier can be enhanced by coating the surface of the carrier with this kind of resin and by thermosetting the resin.

The fixation of electrostatic charging particles or electrically conductive particles to the surface of the binder-type carrier is carried out according to, for example, a method in which the magnetic resin carrier is uniformly mixed with the particles, the particles are attached to the surface of the magnetic resin carrier, and then mechanical and thermal impact forces are applied to the particles to put the particles into the magnetic resin carrier. In this case, the particles are not completely embedded into the magnetic resin carrier but fixed such that parts thereof protrude from the surface of the magnetic resin carrier. As the electrostatic charging particles, organic or inorganic insulating materials are used. More specifically, as organic insulating materials, organic insulating particles, such as polystyrene, styrene copolymers, acrylic resins, various acrylic copolymers, nylon, polyethylene, polypropylene, fluororesins and cross-linked materials of these are available. The charging capability and the charging polarity thereof can be adjusted so as to be suited for the material of the electrostatic charging particles, polymerization catalyst, surface treatment, etc. As the inorganic insulating material, negatively charged inorganic particles, such as silica and titanium dioxide, and positively charged inorganic particles, such as strontium titanate and alumina, are used.

The coated-type carrier is carrier obtained by coating carrier core particles made of a magnetic substance with a resin, and electrostatic charging particles charged positively or negatively can be fixed to the surface of the carrier, as in the case of the binder-type carrier. The charging characteristics, such as polarity, of the coated-type carrier can be adjusted by selecting the kind of the surface coating layer and the electrostatic charging particles. As the coating resin, it is possible to use resins similar to the binder resins for the binder-type carrier.

The mixture ratio of the toner and the carrier of the developer-tank-contained developer 3 is adjusted such that a desired toner charging amount is obtained. The ratio of the toner in the developer-tank-contained developer 3 is preferably 3 to 20 wt % and further preferably 4 to 15 wt % with respect to the total amount of the toner and the carrier. In addition, the replenishment developer 2 stored in the developer replenishing tank 80 contains toner and a small amount of carrier, and the ratio of the carrier in the replenishment developer 2 is preferably 1 to 50 wt % and further preferably 5 to 30 wt %.

The operation of the developing apparatus 34 configured as described above will be described.

At the time of image formation, the sleeve 48*b* of the developing roller 48 is rotated in the direction indicated by the arrow (counterclockwise) on the basis of the driving of the motor (not shown). By the rotation of the first screw 72 and the rotation of the second screw 74, the developer-tank-contained developer 3 existing in the developer stirring and conveying chamber 67 is stirred while being circulated and conveyed between the first conveying passage 68 and the second conveying passage 70. As a result, the toner and the carrier contained in the developer make friction contact and are charged to have polarities opposite to each other. In this embodiment, it is assumed that the carrier is positively charged and that the toner is negatively charged. However, the charging characteristics of the toner and the carrier being used for the present invention are not limited to these combinations. The external size of the carrier is considerably larger than that of the toner. For this reason, the negatively charged toner is attached around the circumference of the positively charged carrier mainly on the basis of the electric attraction force exerted therebetween.

The developer-tank-contained developer 3 charged as described above is supplied to the developing roller 48 in the process of being conveyed to the second conveying passage 70 using the second screw 74. The developer is held on the surface of the sleeve 48*b* by the magnetic force of the magnet 48*a* inside the developing roller 48 and moved while being rotated counterclockwise together with the sleeve 48*b*, the throughput thereof is regulated using the regulating plate 62 disposed so as to be opposed to the developing roller 48, and then the developer is conveyed to the developing area opposed to the photosensitive member 12. Furthermore, in the developing area, chains of particles (magnetic brush) are formed by the magnetic force of the main magnet pole N1 of the magnet 48*a*. In the developing area, by the force of the electric field (electric field of AC superimposed on DC) that is formed between the electrostatic latent image on the photosensitive member 12 and the developing roller 48 to which a developing bias is applied and exerted to the toner, the toner is moved to the electrostatic latent image on the photosensitive member 12, and the electrostatic latent image is developed into a visible image. The developer, the toner of which is consumed in the developing area, is conveyed toward the developer tank 66, detached from the surface of the developing roller 48 by the repulsive magnetic field between the poles N3 and N2 of the magnet 48*a* disposed so as to be opposed to the second conveying passage 70 of the developer tank 66, and then recovered into the developer tank 66. The recovered developer is mixed with the developer-tank-contained developer 3 that is being conveyed to the second conveying passage 70.

When the toner contained in the developer-tank-contained developer 3 is consumed by the image formation described above, it is desirable that the amount of the toner corresponding to the consumed amount is replenished to the developer tank 66. For this purpose, the developing apparatus 34 is equipped with the toner concentration detecting sensor 78 for measuring the ratio of the toner in the developer-tank-contained developer 3 existing in the developer stirring and conveying chamber 67. Furthermore, the developer replenishing tank 80 is provided above the first conveying passage 68.

Next, the operation of the developing apparatus 34 according to the first embodiment will be described referring to FIGS. 4 to 13.

Figure 10:
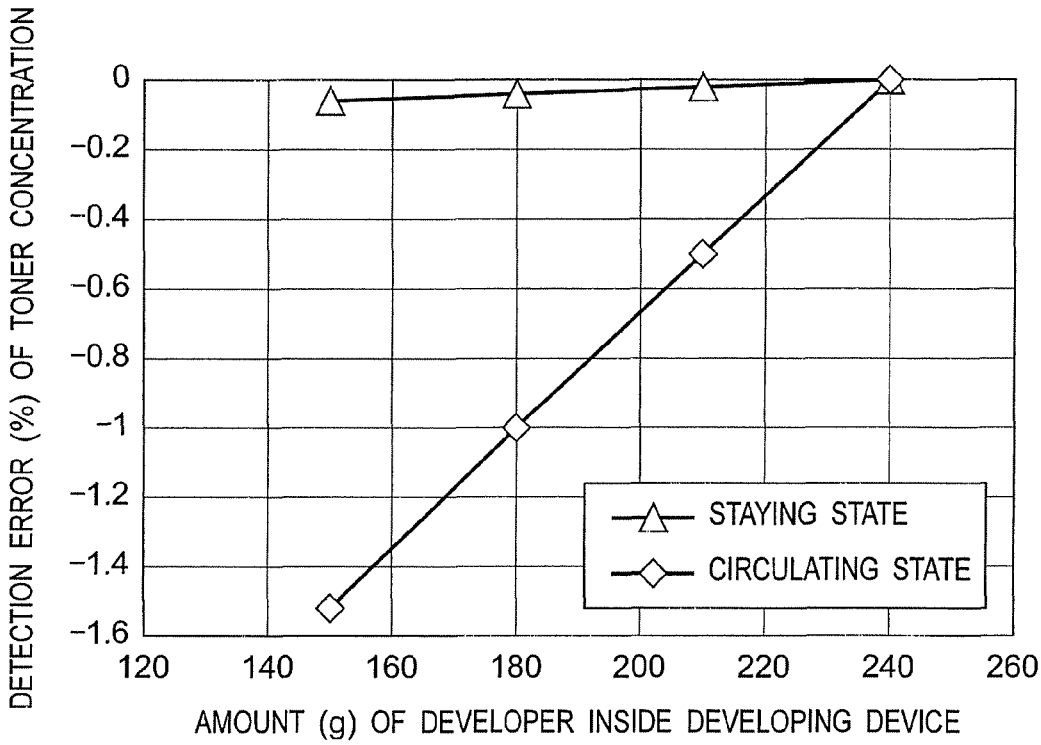
FIG. 10 is a graph showing the relationship between the amount of the developer inside the developing apparatus and the detection error of the toner concentration in the circulating state and the staying state.
Figure 11:
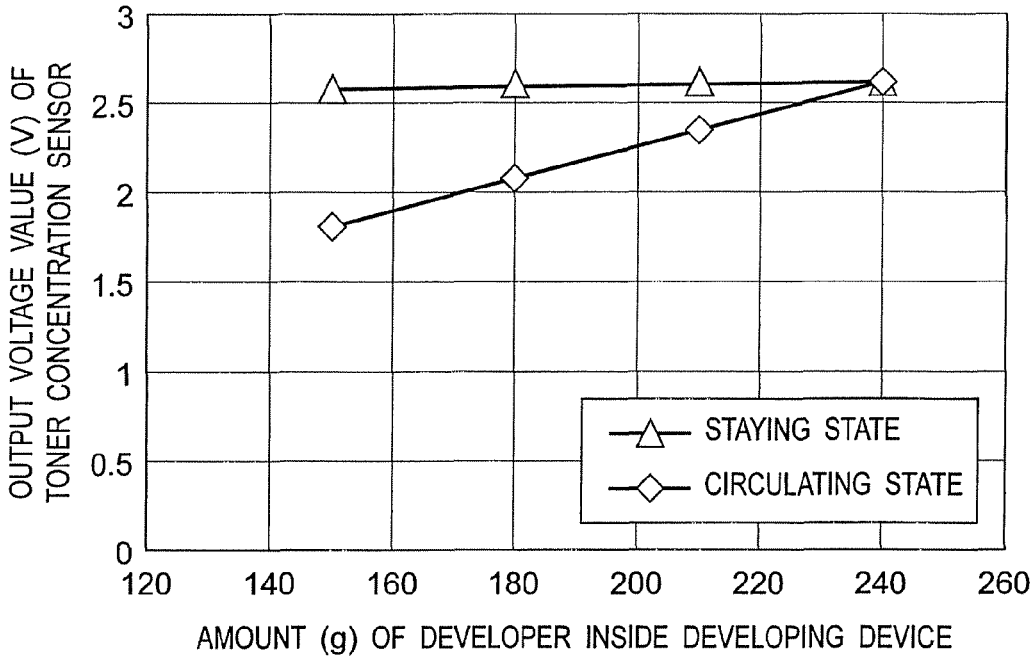
FIG. 11 is a graph showing the relationship between the amount of the developer inside the developing apparatus and the output voltage value of the toner concentration sensor in the circulating state and the staying state.
Figure 13:
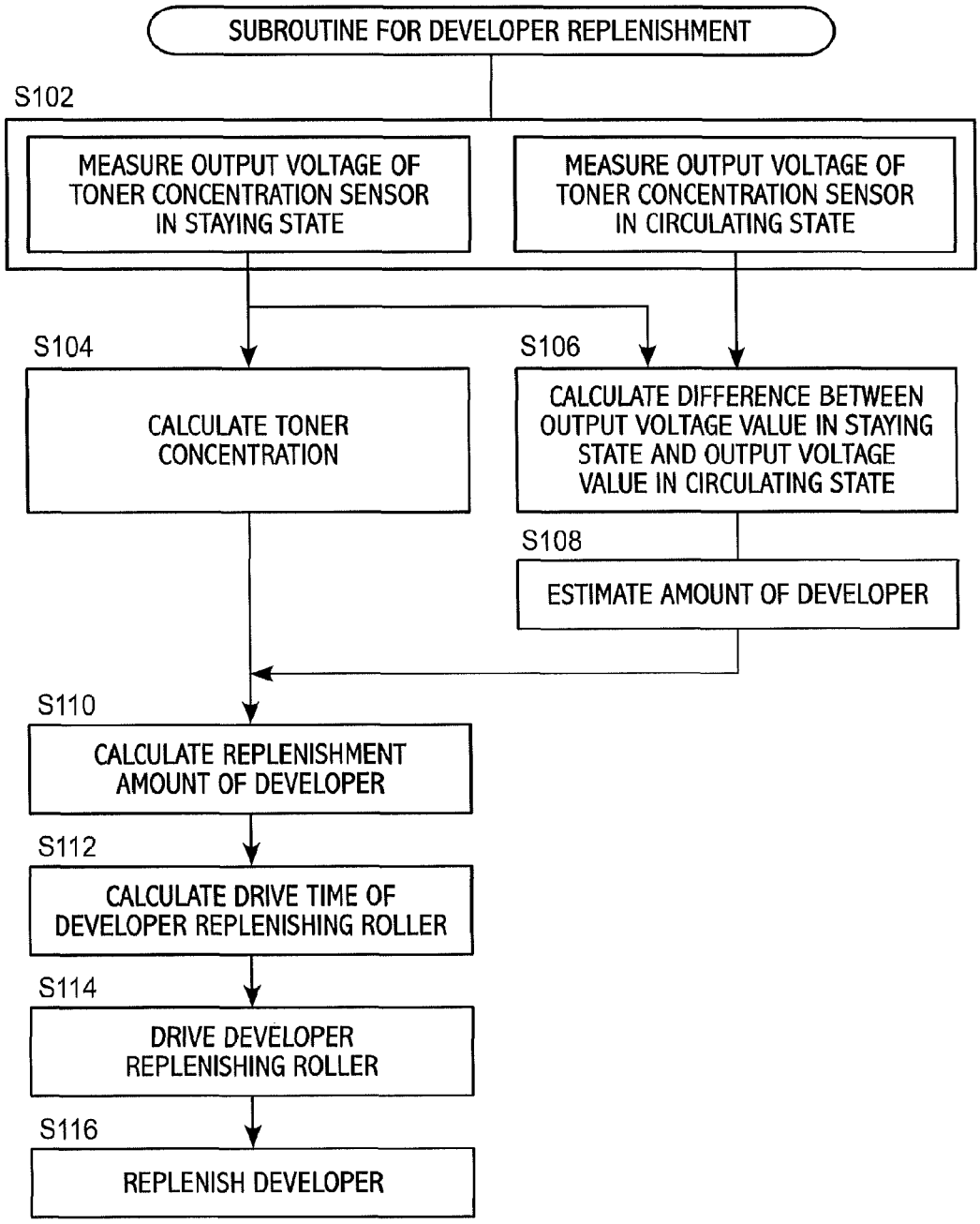
FIG. 13 is a flowchart showing a subroutine for developer replenishing control in the developing apparatus according to the first embodiment of the present invention.
Figure 14:
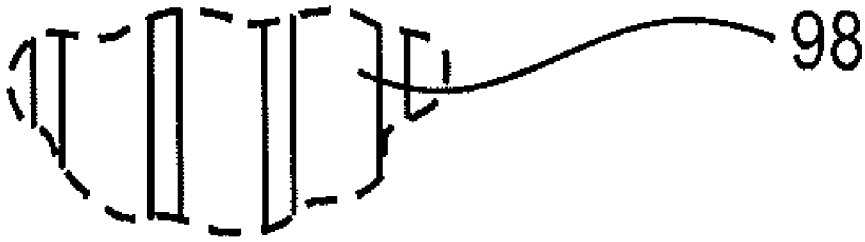
FIG. 14 is a partial view of the opening section being adapted to a slit-shaped opening section.

FIG. 10 is a graph showing the relationship between the amount of the developer inside the developing apparatus 34 and the detection error of the toner concentration in the circulating state and the staying state. FIG. 11 is a graph showing the relationship between the amount of the developer inside the developing apparatus 34 and the output voltage value of the toner concentration sensor in the circulating state and the staying state. FIG. 12 is a view illustrating a method for determining the replenishment amount of the replenishment developer 2 on the basis of the toner concentration and the difference between the output voltage value in the circulating state and the output voltage value in the staying state. FIG. 13 is a flowchart showing a subroutine for developer replenishing control in the entire control (main routine) not shown.

As shown in FIG. 10, in the case that the conveying state switching device 56 is in the circulating state, the detection error is large when the amount of the developer inside the developing apparatus 34 is small (for example, approximately 150 g), and the detection error is small when the amount of the developer inside the developing apparatus 34 is large (for example, approximately 240 g). The reason for this is assumed to be that although the developer is charged sparsely when the amount of the developer inside the developing apparatus 34 is small, the developer is charged densely when the amount of the developer inside the developing apparatus 34 is large, whereby the detection error of the toner concentration detecting sensor due to the density of the developer hardly occurs. Furthermore, in the case that the conveying state switching device 56 is in the staying state, the state in which the detection error is small is maintained regardless of the amount of the developer inside the developing apparatus 34. The reason for this is assumed to be that when the conveying state switching device 56 is in the staying state, the state in which the developer is charged densely is generated. Hence, a sort of approximate toner concentration approximate to the true toner concentration can be obtained by performing measurement using the magnetic-type toner concentration detecting sensor 78 when the staying state is achieved using the conveying state switching device 56, whereby the toner concentration inside the developing apparatus 34 can be measured accurately.

The measurement using the magnetic-type toner concentration sensor 78 when the staying state is achieved using the conveying state switching device 56 has resulted in that the detection error of the toner concentration inside the developing apparatus 34 is large, and this means that information including information regarding the toner concentration inside the developing apparatus 34 and information regarding the amount of the developer inside the developing apparatus 34 is measured. Since the toner concentration is obtained accurately by performing measurement using the magnetic-type toner concentration sensor 78 when the staying state is achieved using the conveying state switching device 56, the information regarding the amount of the developer inside the developing apparatus 34 can be obtained in consideration of the difference between the output voltage value in the staying state and the output voltage value in the circulating state shown in FIG. 11.

As described already, the developer amount estimating table or the calculation formula is stored in the ROM 104 of the controller 100. The developer amount estimating table is a table in which the amount of the developer inside the developing apparatus 34 and the difference between the output voltage value in the staying state and the output voltage value in the circulating state are used as parameters, and the replenishment amount of the replenishment developer 2 is related to the two parameters, for example, as shown in FIG. 12. In FIG. 12, in the case that the difference between the output voltage values is 0.75 to 0.3 V, it is assumed that the amount of the developer inside the developing apparatus 34 is appropriate; in the case that the difference between the output voltage values is more than 1.25 V, it is assumed that the amount of the developer inside the developing apparatus 34 is small; and in the case that the difference between the output voltage values is less than 0.2 V, it is assumed that the amount of the developer inside the developing apparatus 34 is large. Furthermore, when it is assumed that the reference toner concentration is 7 wt % in FIG. 12, in the case that the toner concentration inside the developing apparatus 34 is 6.75 to 7.25 wt %, it is judged that the toner concentration is appropriate; in the case that the toner concentration inside the developing apparatus 34 is higher than 8.25 wt %, it is judged that the toner concentration is high; and in the case that the toner concentration inside the developing apparatus 34 is lower than 5.25 wt %, it is judged that the toner concentration is low.

In the case that the amount of the developer inside the developing apparatus 34 is estimated to be small, if the replenishment of a large amount of the replenishment developer 2 is carried out continuously, the replenishment amount becomes relatively too large, and the toner concentration inside the developing apparatus 34 continues to be high. Hence, in the case that the amount of the developer inside the developing apparatus 34 is estimated to be small, the replenishment of a small amount of the replenishment developer 2 is carried out. Furthermore, in the case that the amount of the developer inside the developing apparatus 34 is estimated to be large, if the replenishment of a small amount of the replenishment developer 2 is carried out continuously, the replenishment amount becomes relatively too small, and the toner concentration Tc inside the developing apparatus 34 continues to be low. Hence, in the case that the amount of the developer inside the developing apparatus 34 is estimated to be large, the replenishment of a large amount of the replenishment developer 2 is carried out.

On the basis of these considerations, specific replenishment amounts corresponding to the parameter regarding the toner concentration and the parameter regarding the amount of the developer (the difference between the output voltage values) have been determined beforehand, and respective replenishment amounts have been stored in the ROM 104 of the controller 100. In FIG. 12, for example, when the toner concentration is 6 wt % and the difference between the output voltage values is 0.9 V, 66 mg of the replenishment developer 2 is replenished.

The adjustment of the replenishment amount of the replenishment developer 2 is carried out by adjusting the drive time of the developer replenishing roller. The drive time of the developer replenishing roller corresponding to the replenishment amount has been obtained beforehand experimentally, and the developer replenishing table or the calculation formula has been stored in the ROM 104 of the controller 100. When a specific replenishment amount is determined, the drive time of the developer replenishing roller corresponding to the replenishment amount is determined by referring to the developer replenishing table or the calculation formula. For example, when 66 mg of the replenishment developer 2 is replenished, the drive time of the developer replenishing roller is 257 ms. The amount of the replenishment developer 2 corresponding to the drive time of the developer replenishing roller flows downward and is supplied to the first conveying passage 68 of the developer tank 66.

A developer replenishment control method, a feature of the present invention, will be described referring to FIG. 13.

At step S102, the conveying state of the developer-tank-contained developer 3 is switched to the staying state using the conveying state switching device 56, and the output voltage value output from the toner concentration detecting sensor 78 in the staying state is measured. Furthermore, the conveying state of the developer-tank-contained developer 3 is switched to the circulating state using the conveying state switching device 56, and the output voltage value output from the toner concentration detecting sensor 78 in the circulating state is measured.

At step S104, the toner concentration of the developer-tank-contained developer 3 inside the developer tank 66 is calculated on the basis of the output voltage value in the staying state obtained at step S102.

At step S106, the difference between the output voltage value in the staying state and the output voltage value in the circulating state, obtained at step S102, is calculated. Then, at step S108, the amount of the developer-tank-contained developer 3 inside the developer tank 66 is estimated on the basis of the difference between the output voltage values obtained at step S106. At step S110, the replenishment amount of toner, i.e., the replenishment amount of the replenishment developer 2, is calculated on the basis of the calculated toner concentration and the estimated amount of the developer-tank-contained developer 3.

At step S112, the drive time of the developer replenishing roller corresponding to the replenishment amount of the replenishment developer 2 is calculated referring to the developer replenishing table or the calculation formula. At step S114, the developer replenishment roller is driven during the calculated drive time. As a result, at step S116, the amount of the replenishment developer 2 corresponding to the drive time of the developer replenishing roller flows downward and is supplied to the first conveying passage 68 of the developer tank 66.

With the embodiment described above, the replenishment amount required for obtaining the desired toner concentration is calculated using the calculated toner concentration and the estimated amount of the developer, and the replenishment amount is supplied to the developer tank 66. Hence, an appropriate amount of the replenishment developer 2 depending on the toner concentration and the amount of the developer inside developing apparatus 34 is replenished for the trickle developing apparatus that uses a two-component developer, whereby excellent image formation can be carried out for an extended period.

Although the description is given using specific numeric values in the above-mentioned embodiment, the present invention is not restricted by the numeric values but can be modified variously without departing from the scope defined in the appended claims and equivalents thereof.

For example, it may be possible that the opening section 88 provided in the developer tank side shielding plate 86 is formed into a slit-shaped opening section 98 obtained by cutting into a slit shape at multiple positions in the cross-section of the first conveying passage 68 of the developer tank 66 and that the shielding section 96 of the first screw 72 is formed into a disc having an opening section 88 adapted to the slit-shaped opening section 98 having multiple slits and provided in the developer tank side shielding plate 86 . The circulating state is achieved when the slit-shaped opening section 88 of the developer tank side shielding plate 86 is overlapped with the opening section of the shielding section 96, and the staying state is achieved when the slit-shaped opening section 98 of the developer tank side shielding plate 86 is not overlapped with the opening section of the shielding section 96. It may also be possible that the above-mentioned slit-shaped opening section 88 has a form extending radially from the rotation axis of the shaft 72*b* or a form extending coaxially around the rotation axis of the shaft 72*b*.

What is claimed is:

1. A developing apparatus having stirring members for stirring a developer-tank-contained developer containing toner and carrier inside a developer tank while conveying said developer and a developer holder disposed adjacent to said stirring members to supply said stirred developer-tank-contained developer to an electrostatic latent image holder, comprising:

a developer replenishing tank for replenishing said toner and said carrier to said developer tank, a magnetic-type toner concentration detecting sensor for detecting the toner concentration inside said developer tank, a discharging mechanism provided in said developer tank to discharge an excessive amount of said developer-tank-contained developer outside said developer tank when the amount of said developer-tank-contained developer inside said developer tank exceeds a predetermined amount, a conveying state switching device for temporarily blocking the flow of said developer-tank-contained developer in said developer tank and for temporarily switching a circulating state of said developer-tank-contained developer to a staying state thereof, and a controller for controlling replenishment operation for replenishing said toner and said carrier for replenishment from said developer replenishing tank to said developer tank when the toner concentration detected using said toner concentration detecting sensor is lower than a predetermined reference toner concentration, wherein said controller calculates the toner concentration on the basis of the output value output from said toner concentration detecting sensor when the staying state is achieved and estimates the amount of said developer inside said developer tank on the basis of the difference between the circulating state output value and the staying state output value, output from said toner concentration detecting sensor, thereby determining the amounts of said toner and said carrier to be replenished on the basis of the calculated toner concentration and the estimated amount of said developer;

wherein said conveying state switching device comprises an opening section disposed orthogonal to the conveying passage of said developer tank and a shielding section installed on said stirring member and formed so as to shield said opening section, and the circulating state is generated when said opening section is not overlapped with said shielding section, and the staying state is generated when said opening section is overlapped with said shielding section, whereby the conveying state of said developer-tank-contained developer is switched to the circulating state or the staying state.

2. The developing apparatus according to claim 1, wherein said opening section is a semicircular opening section obtained by cutting off the lower portion of the conveying cross-section of said developer tank.

3. The developing apparatus according to claim 1, wherein said opening section is a slit-shaped opening section obtained by cutting into a slit shape at multiple positions in the conveying cross-section of said developer tank.

4. An image forming machine having a rotatable electrostatic latent image holder for holding electrostatic latent images on the circumferential face thereof, stirring members for stirring a developer-tank-contained developer containing toner and carrier inside a developer tank while conveying said developer and a developer holder disposed adjacent to said stirring members to supply said stirred developer-tank-contained developer to said electrostatic latent image holder, comprising:

a developer replenishing tank for replenishing said toner and said carrier to said developer tank, a magnetic-type toner concentration detecting sensor for detecting the toner concentration inside said developer tank, a discharging mechanism provided in said developer tank to discharge an excessive amount of said developer-tank-contained developer outside said developer tank when the amount of said developer-tank-contained developer inside said developer tank exceeds a predetermined amount, a conveying state switching device for temporarily blocking the flow of said developer-tank-contained developer in said developer tank and for temporarily switching a circulating state of said developer-tank-contained developer to a staying state thereof, and a controller for controlling replenishment operation for replenishing said toner and said carrier for replenishment from said developer replenishing tank to said developer tank when the toner concentration detected using said toner concentration detecting sensor is lower than a predetermined reference toner concentration, wherein said controller calculates the toner concentration on the basis of the output value output from said toner concentration detecting sensor when the staying state is achieved and estimates the amount of said developer inside said developer tank on the basis of the difference between the circulating state output value and the staying state output value output from said toner concentration detecting sensor, thereby determining the amounts of said toner and said carrier to be replenished on the basis of the calculated toner concentration and the estimated amount of said developer;

wherein said conveying state switching device comprises an opening section disposed orthogonal to the conveying passage of said developer tank and a shielding section installed on said stirring member and formed so as to shield said opening section, and the circulating state is generated when said opening section is not overlapped with said shielding section, and the staying state is generated when said opening section is overlapped with said shielding section, whereby the conveying state of said developer-tank-contained developer is switched to the circulating state or the staying state.

5. The image forming machine according to claim 4, wherein said opening section is a semicircular opening obtained by cutting off the lower portion of the conveying cross-section of said developer tank.

6. The image forming machine according to claim 4, wherein said opening section is a slit-shaped opening section obtained by cutting into a slit shape at multiple positions in the conveying cross-section of said developer tank.

7. A developing method applied to a developing apparatus having stirring members for stirring a developer-tank-contained developer containing toner and carrier inside a developer tank while conveying the developer and a developer holder disposed adjacent to said stirring members to supply said stirred developer-tank-contained developer to an electrostatic latent image holder, a developer replenishing tank for replenishing said toner and said carrier to said developer tank, a magnetic-type toner concentration detecting sensor for detecting the toner concentration inside said developer tank, a discharging mechanism provided in said developer tank to discharge an excessive amount of said developer-tank-contained developer outside said developer tank when the amount of said developer-tank-contained developer inside said developer tank exceeds a predetermined amount, a conveying state switching device for temporarily blocking the flow of said developer-tank-contained developer in said developer tank and for temporarily switching a circulating state of said developer-tank-contained developer to a staying state thereof, and a controller for controlling replenishment operation for replenishing said toner and said carrier for replenishment from said developer replenishing tank to said developer tank, comprising the steps of:

calculating the toner concentration on the basis of the output value output from said toner concentration detecting sensor when the staying state is achieved, estimating the amount of said developer inside said developer tank on the basis of the difference between the output value in the circulating state and the output value in the staying state, output from said toner concentration detecting sensor, determining the amounts of said and said carrier to be replenished on the basis of the calculated toner concentration and the estimated amount of said developer, and replenishing the amounts of said toner and said carrier determined at the replenishment amount determining step from said developer replenishing tank to said developer tank;

wherein said conveying state switching device comprises an opening section disposed orthogonal to the conveying passage of said developer tank and a shielding section installed on said stirring member and formed so as to shield said opening section, and the circulating state is generated when said opening section is not overlapped with said shielding section, and the staying state is generated when said opening section is overlapped with said shielding section, whereby the conveying state of said developer-tank-contained developer is switched to the circulating state or the staying state.

8. The developing method according to claim 7, wherein said opening section is a semicircular opening section obtained by cutting off the lower portion of the conveying cross-section of said developer tank.

9. The developing method according to claim 7, wherein said opening section is a slit-shaped opening section obtained by cutting into a slit shape at multiple positions in the conveying cross-section of said developer tank.

* * * * *